US008850648B2

(12) United States Patent
D'Andrea

(10) Patent No.: US 8,850,648 B2
(45) Date of Patent: Oct. 7, 2014

(54) BED AND RAIL COVER

(76) Inventor: Regina Jacqueline D'Andrea, South Portland, ME (US)

( * ) Notice: Subject to any disclaimer, the term of this patent is extended or adjusted under 35 U.S.C. 154(b) by 97 days.

(21) Appl. No.: 13/385,724

(22) Filed: Sep. 2, 2011

(65) Prior Publication Data

US 2013/0055505 A1 Mar. 7, 2013

(51) Int. Cl.
*A47C 21/00* (2006.01)
*A61G 7/05* (2006.01)

(52) U.S. Cl.
CPC ..... *A61G 7/0507* (2013.01); *A61G 2007/0522* (2013.01)
USPC ..... 5/663; 5/658; 5/424

(58) Field of Classification Search
USPC ..... 5/663, 658, 657, 691, 723, 424, 425, 5/946
See application file for complete search history.

(56) References Cited

U.S. PATENT DOCUMENTS 2,128,978 A * 9/1938 Akin ..... 5/93.1
3,321,779 A * 5/1967 Kaufman et al. ..... 5/93.1
4,089,497 A * 5/1978 Miller et al. ..... 248/345.1
5,410,765 A * 5/1995 Youngblood ..... 5/93.1
5,479,112 A * 12/1995 Choi et al. ..... 326/34
5,481,772 A * 1/1996 Glynn et al. ..... 5/663
5,575,025 A * 11/1996 Peters ..... 5/600
5,771,506 A * 6/1998 Joiner ..... 4/575.1
D427,834 S * 7/2000 Buckley ..... D6/610
6,453,492 B1 * 9/2002 Sturrock ..... 5/482
6,668,399 B2 * 12/2003 Malstaff et al. ..... 5/424
7,086,106 B1 * 8/2006 Hairston ..... 5/691
7,458,117 B2 * 12/2008 Schaefer ..... 5/495
2003/0150057 A1 * 8/2003 Malstaff et al. ..... 5/424
2006/0137095 A1 * 6/2006 Schaefer ..... 5/482
2013/0055505 A1 * 3/2013 D'Andrea ..... 5/663

* cited by examiner

*Primary Examiner* — Robert G Santos
(74) *Attorney, Agent, or Firm* — Donald J. MacDonald; Coleman & MacDonald Law Office

(57) ABSTRACT

A bed plate attaches to inner rail plates on each side with hinges or the like, which slides into a bed and rail plate envelope. This bed and rail cover may be placed on top of a hospital bed. When the bed rails are locked in an upwards position the bed cover envelope may be fastened to the outer bed rails or bed frame to hold it in place. The firmness of the bed and rail cover eliminates the possibility of the patient enstranglment in-between the mattress, bed frame, or side rails. The padding within the bed and rail plate envelope eliminates the risk of patients injuring themselves while hitting the bed frame or bed rail.

6 Claims, 2 Drawing Sheets

BED AND RAIL COVER

STATEMENT REGARDING FEDERALLY SPONSORED RESEARCH OR DEVELOPMENT

There has been no federally sponsored research or development involved in this patent application.

DESCRIPTION OF THE FIGURE(S) OF THE DRAWING

DETAILED DESCRIPTION OF THE PREFERRED EMBODIMENT

Figure 1:
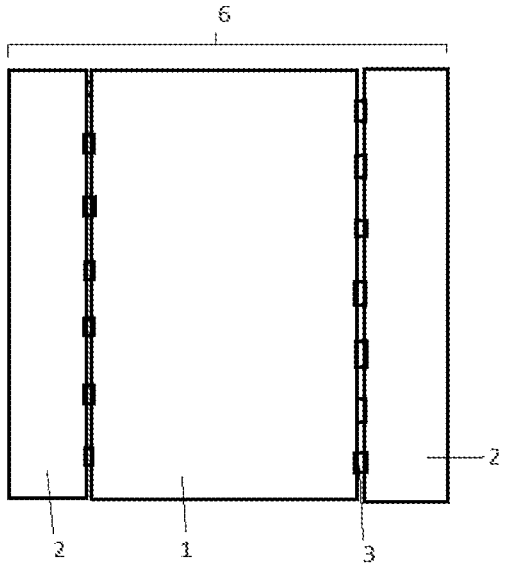
FIG. 1 is a frontal view of the bed cover and inner rail covers.
Figure 2:
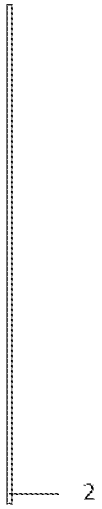
FIG. 2 is a side view of the bed cover and inner rail covers.

Referring to FIG. 1, the bed plate 1, preferably formed of metal or plastic or any other firm material, is fitted to the size of the bed (from side rail to side rail) or slightly narrower. This bed plate 1 attaches to two inner rail plates 2 on the long side of the bed plate 1, with a single inner rail plate 2 on each side. The inner rail plates 2 may attach to the bed plate 1 with hinges or any other mechanism that will hold the pieces together firmly while still allowing movement. It is preferred that the hinges extend the entire length of the bed plate 1 to eliminate spaces a patient could wedge a body, but it is not necessary as long as the spaces between the bed plate 1 and inner rail plates 2 are small enough to prevent enstranglement of any body part.

Figure 3:
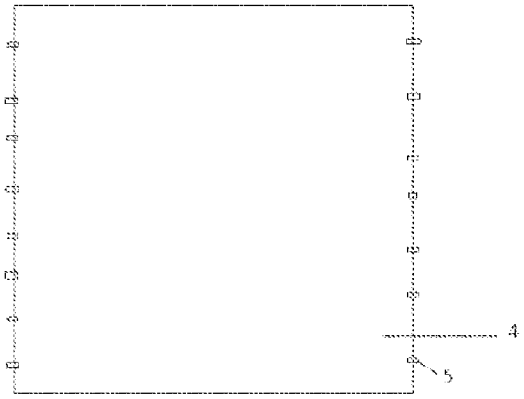
FIG. 3 is a frontal view of the bed cover envelope.
Figure 4:
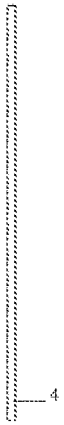
FIG. 4 is a side view of the bed cover envelope

Referring to FIG. 3, the bed and rail plate envelope 4 is preferably formed of a heavy cotton cloth or fleece or some other material or fabric that is non-irritating. The bed and rail plate envelope 4 includes an inner lining the width of the bed and rail plate 6 combined creating a pocket across the front side of the bed and rail plate envelope 4 in which any type of padding, such as batting material, foam padding, and the like, may be inserted. The bed and rail plate envelope includes mating fasteners 5, such as Velcro®, snaps, button, hooks and loops, and the like on the outer edges. In one embodiment, the padding within the bed and rail envelope 4 extends beyond the width of the bed and rail plate 6. In one embodiment, the entire bed and rail plate cover, including the bed and rail plate 6 and the bed and rail plate envelope 4 does not cover the entire length of the bed. In one embodiment, the bed and rail cover includes an additional plate postionable on top of the bed rail. In one embodiment the rail cover includes an additional plate postionable on the outer side of the bed rail. In one embodiment the rail cover includes padding on top of the additional plates on top of the bed rail and on the outer side of the bed rail.

In operation, the bed plate 1 with attached inner rail plates 2 may be slid into the bed and rail plate envelope 4. The bed plate 1 and inner rail plates 2 may be attached to the bed and rail plate envelope 4 with mating fasteners, Velcro®, snaps, buttons, hooks and loops, and the like. The bed and rail cover may then be placed on top a bed so the bed plate 1 covers the entire bed and the padding is facing up. The inner rail plates 2 may be lifted and placed on top the bed plate 1 so the bed rails may be lifted and locked into place. The inner rail plates 2 may then be lifted to cover the inner portion of the bed rails.

The bed and rail plate envelope 4 may then be fastened to the top of the bed rail, outer portion of the bed rail, or the bed frame with mating fasteners 5, such as VELCRO®, snaps, buttons, hooks and loops, and the like.

While the invention is susceptible to various modifications and alternative forms, specific embodiments thereof have been shown in the drawings and are herein described in detail. It should be understood, however, that the invention is not to be limited to the particular form disclosed, but to the contrary, the invention is to cover all modifications, equivalents, and alternatives falling within the spirit and scope of the appended claims.

Feature Description

Field of Invention:

The present invention relates to beds and bed rails by preventing enstranglement.

Background of the Invention:

A bed rail is a rail along the side of a bed connecting the headboard to the footboard. Bed rails are intended to prevent falls by limiting the person's ability to move off the bed. Preventing falls is a great concern in the health care field because they can harm the patient; patient's may suffer broken bones, skin lacerations, bruises, brain trauma, and more. Health care providers do not use bed rails to prevent falls because bed rails present an enstranglement risk. A patient may wedge a body part, such as their head. into an opening or crevice between the bed, bed frame, and bed rail, resulting in suffocation and possibly death. Currently, health care professionals prevent patients from falling out of bed by encouraging the patient to use the call bell before getting out of bed, placing the bed in a low position, and placing a mat on the floor beside the bed. Some patients are unable or unwilling to ring the call bell before getting out of bed and attempt to get out of bed by themselves, regardless of their ability. Despite the low bed and mat, patients can and do injure themselves by trying to get out of bed by themselves when they are unable to do so. Health care providers are responsible for supervising entire units and when they hear a patient moving they are responsible for entering the patient's room and assisting them out of bed. This is a very challenging task for even the most attentive caregiver, which is why patient's continue to suffer injuries from bed falls despite these precautions. It would be advantageous to provide a device that reduces enstranglement risks associated with bed rails so bed rails may be used to prevent falls.

Summary of the Invention:

A bed and rail cover eliminates the enstranglement risk associated with bed rails by preventing the user from wedging any body part in-between the bed, bed frame, and bed rail. The firmness of the bed cover prevents the user from wedging any body part in-between the bed, bed frame, and bed rail. The padding within the bed and rail cover envelope prevent the patient from injuring themselves if they hit the bed and rail cover with any body part. The bed and rail cover may be secured to the bed rail or bed frame to hold it in place. The bed and rail cover may be used for patients who are unable to get out of bed by themselves.

Other aspects and features of the present invention will become apparent from consideration of the following description taken in conjunction with the accompanying drawings.

What is claimed is:

1. A bed and rail cover for use with a hospital bed having rails, the bed and rail cover comprising:

a bed plate defining a length and a width;

a pair of rail plates, one each hingedly coupled to a side of the bed plate along the length of the bed plate;

a pair of first additional plates, one of the first additional plates coupled to each of the rail plates;

a pair of second additional plates, one of the second additional plates coupled to each of the first additional plates:

the bed and rail cover being positionable on top of a hospital bed, the bed plate configured to extend substantially over the entire length and width of the hospital bed, the rail plates being positionable to extend generally vertically from the top of the hospital bed and cover an inner portion of the rails of the bed, the first additional plates being postionable on top of the rails of the bed, the second additional plates being positionable adjacent the outer side of the rails of the bed, the bed and rail cover to aid in preventing a user of the bed from wedging a body part between a frame and/or a rail of the bed.

2. The bed and rail cover according to claim 1 further comprising a bed and rail plate envelope enclosing the bed plate and the rail plates.

3. The bed and rail cover of claim 2, wherein the bed plate and rail plates fastens to the bed and rail plate envelope with mating fasteners.

4. The bed and rail cover of claim 1, wherein the bed plate, does not cover the entire length of a hospital bed.

5. The bed and rail cover of claim 1, further comprising padding on top of the first additional plate on top of the rail of the bed.

6. The bed and rail cover of claim 1, further comprising a padding disposed on the first and second additional plates.

* * * * *